United States Patent [19]

Dutcher

[11] 4,269,346

[45] May 26, 1981

[54] ROUND ICE CREAM CARTON

[75] Inventor: Daniel P. Dutcher, Woodbury, Minn.

[73] Assignee: Champion International Corporation, Stamford, Conn.

[21] Appl. No.: 88,413

[22] Filed: Oct. 26, 1979

[51] Int. Cl.[3] ..... B65D 3/00; B65D 3/04

[52] U.S. Cl. ..... 229/21; 229/16 A

[58] Field of Search ..... 229/21, 16 A, 41 C, 229/1.5 B

[56] References Cited

U.S. PATENT DOCUMENTS

| | | | |
|---|---|---|---|
| 2,088,832 | 8/1937 | Barbieri | 229/21 X |
| 2,189,436 | 2/1940 | Rosemfield | 229/21 |
| 2,240,599 | 5/1941 | Amberg | 229/16 A |
| 2,819,833 | 1/1958 | Sauer | 229/41 C |
| 3,269,640 | 8/1966 | Armeson | 229/21 |
| 3,381,877 | 5/1968 | Armesom | 229/21 |
| 3,411,692 | 11/1968 | Mathews | 229/21 |
| 3,633,814 | 1/1972 | Michetti | 229/21 |
| 3,918,629 | 11/1975 | Forbes, Jr. et al. | 229/21 |
| 4,153,196 | 5/1979 | Dutcher | 229/1.5 B |

*Primary Examiner*—Davis T. Moorhead
*Attorney, Agent, or Firm*—Evelyn M. Sommer

[57] ABSTRACT

A cylindrically shaped, open topped carton suitable for containing ice cream or the like includes a polygonal shaped base and a pair of side wall sections formed integral with the base which are joined together along mutual edges to provide an essentially cylindrical exterior surface defining a circular opening in one end of the carton opposite the base. A plurality of Y-shaped pleats are provided in lower portions of the side walls at circumferentially spaced intervals corresponding to the juncture of the edges defining the polygonal base to provide a smooth transition of the side walls from an angular cross-section at the base to a circular cross-section at the open end of the carton. A multi-ply rim provided with specially configured extension flaps for holding the rim in place on the side walls of the carton extends outwardly from the side walls to assure tight frictional engagement with a removable lid while also facilitating lid removal.

15 Claims, 18 Drawing Figures

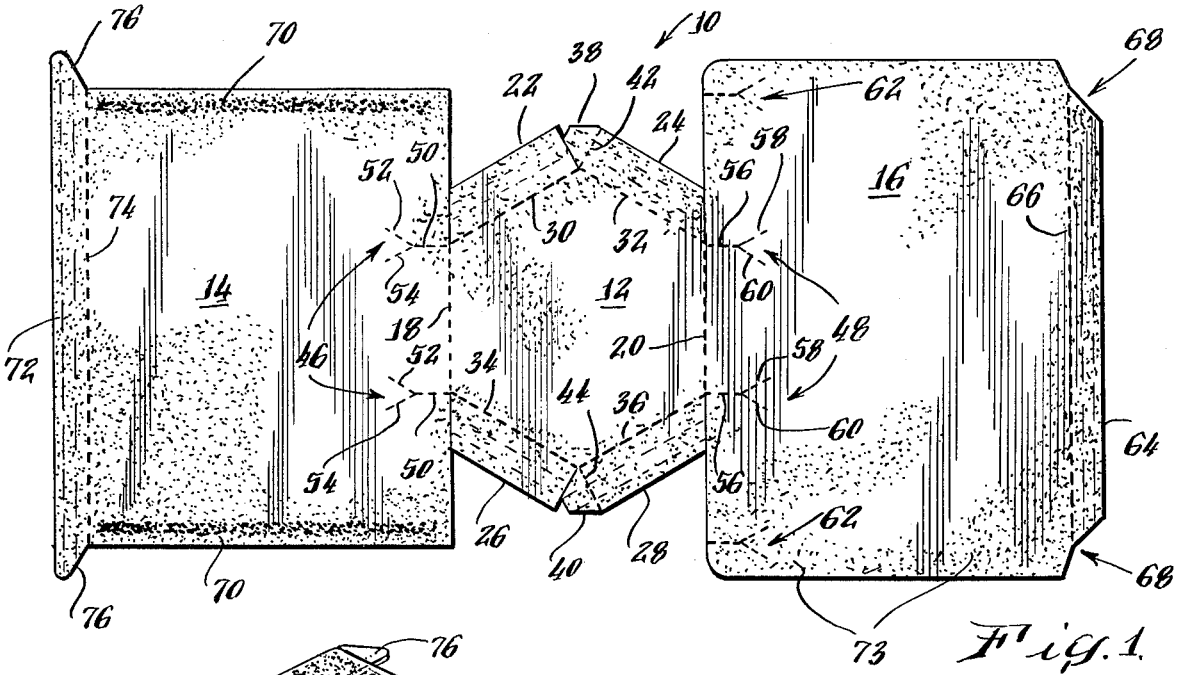
Fig. 1.
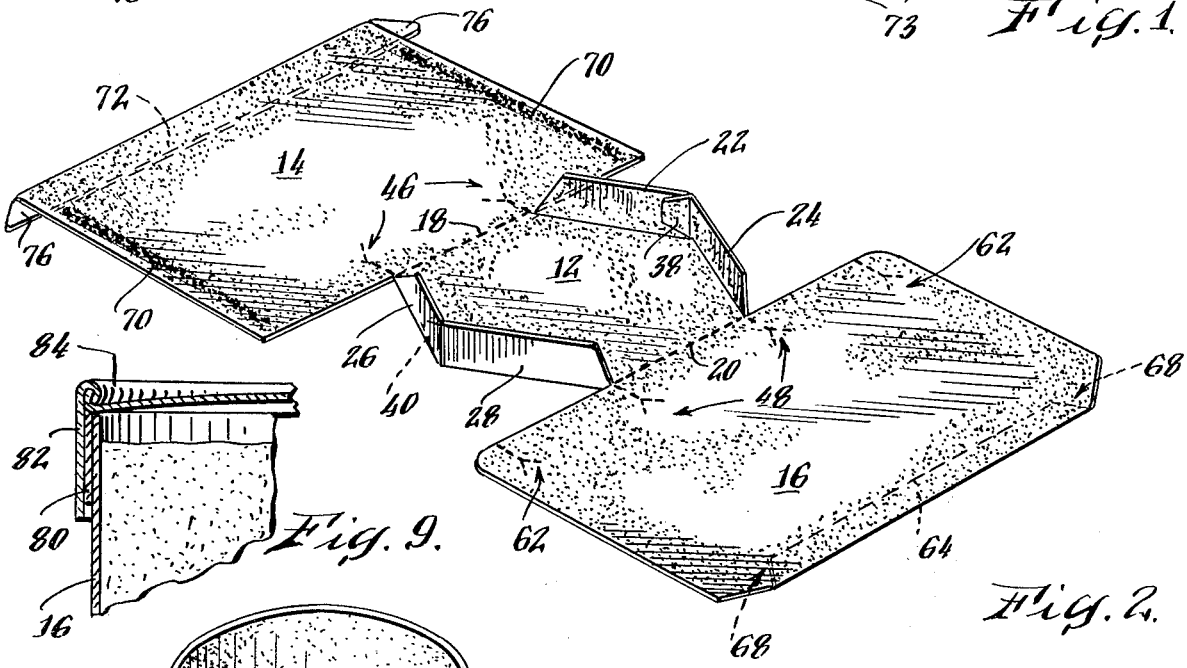
Fig. 2.
Fig. 9.
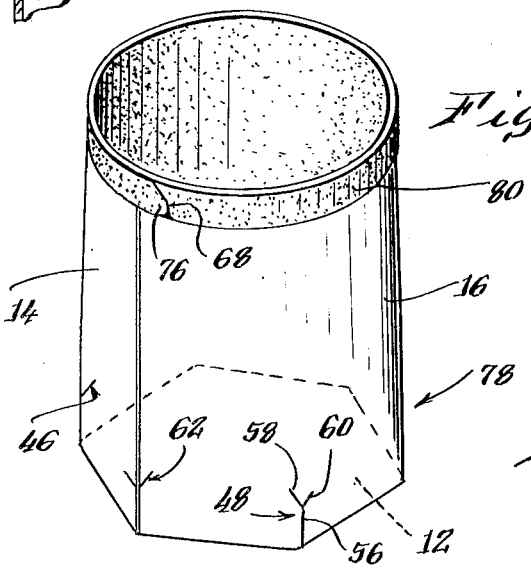
Fig. 3.
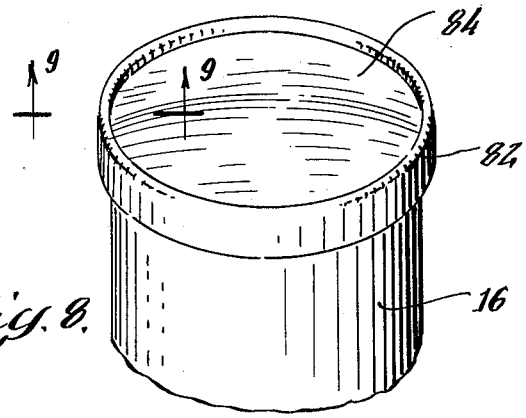
Fig. 8.

ROUND ICE CREAM CARTON

TECHNICAL FIELD

This invention generally relates to packaging cartons, and deals more particularly with a cylindrically shaped, open topped carton and lid therefor suitable for packaging ice cream or the like.

BACKGROUND AND BRIEF DESCRIPTION OF THE INVENTION

Cylindrically shaped, open topped cartons have frequently been used in the past for packaging of ice cream or the like. Although rectangularly shaped cartons for this purpose have also been employed to some extent in recent periods, the cylindrically shaped, or "round" ice cream carton tends to connote "homemade" or "old fashion" ice cream in the mind of the public and thus remains desirable for use with particular types of ice cream products to convey an impression of quality. In the past, round ice cream cartons of the type made from paper stock have been of an essentially multi-piece construction, typically including a separate bottom wall which is joined to one end of a cylindrically shaped sleeve. Various means have been devised to attach the bottom wall to the sleeve forming the side walls of the carton. These prior constructions have been less than completely satisfactory either because of the inadequate sealing of the bottom to the side walls, which resulted in leaking of the carton, or because the resulting construction was not sufficiently rigid to maintain the bottom in proper position, particularly when the ice cream had melted slightly and permeated the paper stock thereby weakening the same. Moreover, the use of a separate bottom and side walls to form the carton increased manufacturing costs as a result of the necessity of individually form separate sections of the carton and later attach the various sections together before erecting the carton into its completed form.

Known prior art cartons of the cylindrical type are less than desirable for a number of reasons including inadequate sealing between the lid and container, lack of structural integrity particularly in the base thereof, and a non-smooth transition in the shape of the sidewalls from an angularly shaped base on one end of the container to a round cross-section at the other end thereof. Thus, there is a need in the art for a cylindrically shaped ice cream carton which may be formed from a unitary sheet of paper stock and simply erected to form a strong, leakproof package having side walls with a smooth transition in the cross-section geometry thereof.

The present invention provides a round ice cream carton which eliminates the deficiencies inherent in prior art designs and provides a carton construction which is not only particularly economical from a manufacturing standpoint, but is exceptionally strong and not prone to allow leakage of the contents therefrom. According to the present invention, a cylindrically shaped, open topped ice cream carton is formed from a blank comprising a unitary sheet of paper stock cut and configured to present a polygonally shaped bottom panel having a pair of rectangularly shaped side wall panels joined by fold lines to diametrically opposite edges of the bottom panel. When erected, the lower edges of the side walls conformingly join to each of the plurality of edges defining the polygonal periphery of the bottom. The side walls are provided with a plurality of circumferentially spaced, Y-shaped pleats therein adjacent the juncture of the straight edges of the bottom to produce a smooth and rapid transition of the side walls from a polygonal cross-section near the bottom thereof to a circular cross-section in intermediate and upper sections thereof. One or more strips of the paper stock circumscribing the rim of the carton is folded into overlapping relationship with the side walls to provide a double or triple thickness rim for frictionally engaging a lid installed over the top of the carton. Alternatively, the paper stock defining the opening in the carton may be rolled to form a bead-type rim. Specially configured wings or securement tabs on the reinforcement strips provide an especially effective means for maintaining the strips in a flush folded condition against the side walls of the carton.

BRIEF DESCRIPTION OF THE DRAWINGS

In the drawings, which form an integral part of the specification and are to be read in conjunction therewith, and in which like parts are designated by like reference numerals and the various views:

FIG. 1 is a plan view of a blank for forming a round ice cream carton which comprises the preferred form of the present invention, wherein stipling indicates a coating of a moisture resistant material applied to one face thereof;

FIG. 2 is a perspective view of the blank of FIG. 1, shown during an intermediate stage in the folding thereof into the round carton;

FIG. 3 is a top perspective view of the erected carton formed from folding the blank of FIG. 1;

FIG. 8 is a fragmentary, top perspective view of the carton shown in FIG. 3, but shown with a closure lid installed thereon;

FIG. 9 is a sectional view taken along the line 9—9 in FIG. 8;

DETAILED DESCRIPTION OF THE INVENTION

Figure 4:
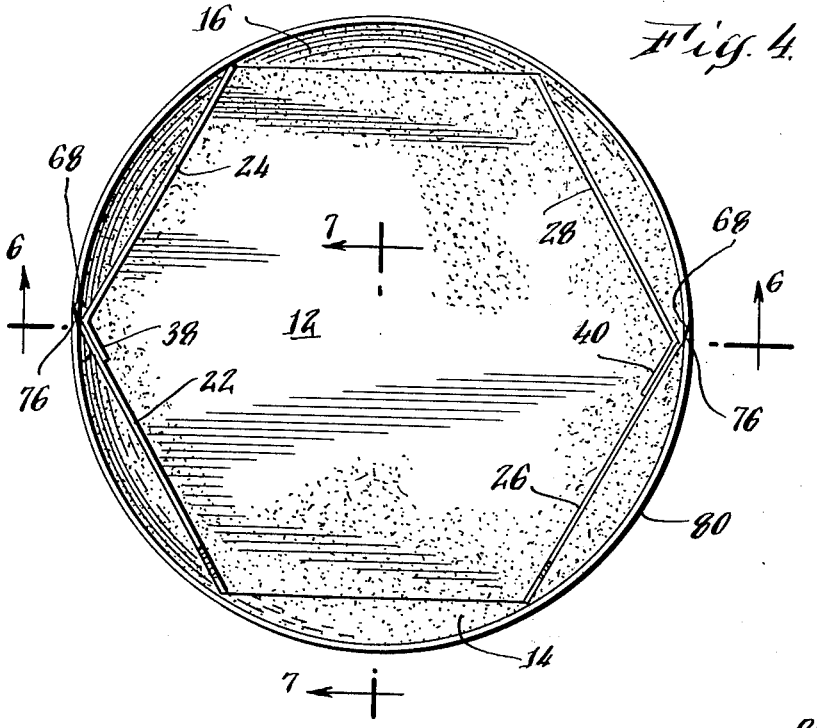
FIG. 4 is a top plan view, taken on a larger scale of the carton of FIG. 3.
Figure 5:
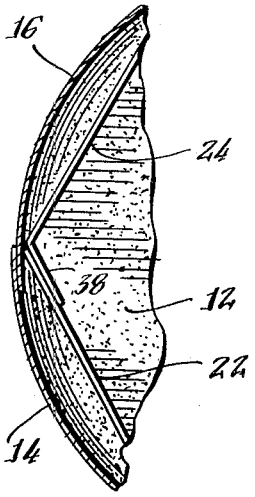
FIG. 5 is a fragmentary, sectional view taken along the line 5—5 in FIG. 6.
Figure 6:
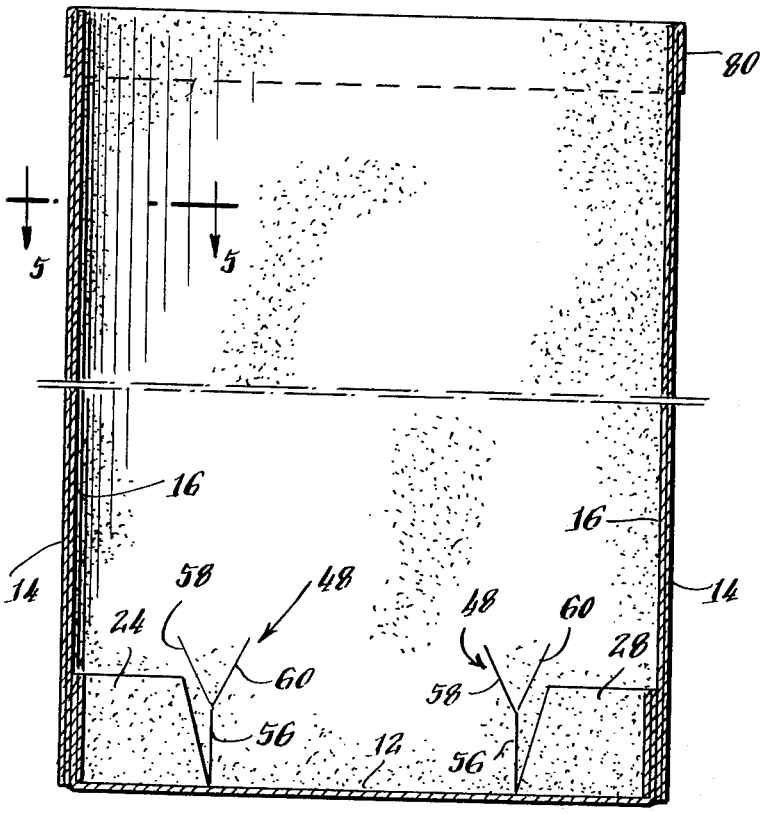
FIG. 6 is a cross-sectional view taken along the line 6—6 in FIG. 4.
Figure 7:
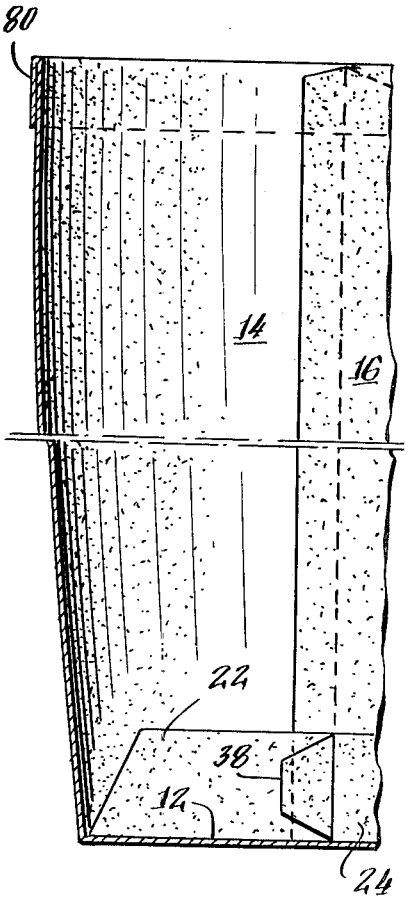
FIG. 7 is a fragmentary, sectional view taken along the line 7—7 in FIG. 4.

Referring first to FIGS. 1 and 2, a blank generally indicated by the numeral 10 includes a polygonally shaped bottom panel 12 interposed between a pair of spaced apart, rectangularly shaped side wall panels 14 and 16. Bottom panel 12 is regular in shape and includes three sets of diametrically opposed, parallel edges, two of which are joined by fold lines 18 and 20 to opposing parallel edges of side wall panels 14 and 16 respectively. Bottom panel 12 and side wall panels 14 and 16 are symetrically positioned with respect to each other such that a horizontal reference axis extending through the mid point of bottom panel 12 divides the bottom panel 12, and side panels 14 and 16 into equal, top and bottom mirror-image halves.

Bottom panel 12 is provided with polygonally shaped glue flaps 22, 24, 26 and 28 respectively joined thereto by fold lines 30, 32, 34 and 36, which latter mentioned fold lines define the remaining two sets of diametrically opposed edges of bottom panel 12. Glue flaps 24 and 28 respectively include connecting flaps 38 and 40 joined by corresponding fold lines 42 and 44 on one end thereof adjacent associated glue flaps 22 and 26 and disposed within a V-shaped opening between the adjacent extremities of flaps 22 and 24, and flaps 26 and 28.

Side wall panels 14 and 16 are each provided with a pair of spaced, Y-shaped score or crease lines therein, respectively generally designated by the numerals 46 and 48. More particularly, score lines 46 comprises a first leg 50 extending from a point adjacent the opposite extremities of score line 18, perpendicularly outward away from the latter, and further include a second and third leg 52 and 54 respectively connected to the first leg 50 and diverging away from each other outwardly from the bottom panel 12. Score lines 48 each include similar first, second and third legs, 56, 58 and 60 respectively. Side wall panel 16 is also provided a second set of similar Y-shaped score lines 62 on opposite sides of score lines 48 and spaced outwardly from the latter. The spacing between each of the score lines 48 and 62 along the edge of the wall panel 16 coextensive with fold line 20 is essentially equal.

Side wall panel 16 is provided with an elongate, trapezoidally shaped flap member 64 along one outer edge thereof defined by score line 66. The opposite extremities of flap member 64 are truncated to define notches 68 whose purpose will become later apparent. Side wall panel 14 is provided with a pair of preapplied adhesive strips 70 along two opposite edges thereof, while a flap member 72 is defined along the remaining edge of panel 14 by a score line 74 which extends parallel to the score line 66 defining flap member 64. Flap member 72 includes a pair of triangularly shaped extension flaps 76 on the opposite extremities thereof.

One side of the blank 10, which defines the interior of the carton when folded, is provided with a suitable coating 73 of moisture resistant material thereon, such as polyethelene or the like.

The first step in folding the blank 10 to form a round ice cream carton involves the step of pivoting the glue flaps 22, 24, 26 and 28 90° upwardly about their respective fold lines 30, 32, 34 and 36, to an essentially upright position whereupon connecting flaps 38 and 40 may be joined as by gluing to the inner surfaces of the corresponding glue flaps 22 and 26. Simultaneously, with the upward folding of the last mentioned glue flaps, or prior thereto, flap members 64 and 72 are pivoted 180° about their respectively corresponding score lines 66 and 74 into overlapping relationship with the bottom side of the respectively associated side wall panels 16 and 14. A suitable adhesive may be applied between the flap members 64 and 72 and the overlapped, exterior surfaces of the side wall panels 14 and 16 to hold the flap members 64 and 72 firmly in place.

Side wall panels 14 and 16 are pivoted 90° upwardly about the respectively associated fold lines 18 and 20, to an upright position. Adhesive is then applied to the outer surfaces of glue flaps 22, 24, 26 and 28. The opposite extremities of side wall panel 16 on opposite sides of fold line 20 are folded toward sidewall panel 14 and into abuttingly overlapping relationship to the adjacent glue flaps 24 and 28; the length of panel 16 is sufficient in order that the lower opposite extremities thereof slightly overlap portions of the glue flaps 22 and 26 as well. Next, the opposite lateral sides of side wall panel 14 are folded inwardly toward side wall panel 16 whereby to overlap the corresponding vertical edges of panel 16. The adhesive strips 70 may then be pressed against the underlying edges of panel 16 whereby to join the vertical edges of side wall panels 14 and 16 to form a cylindrically shaped tube. The lower edges of side wall panel 14 abuttingly overlap the exterior surface areas of glue flaps 22 and 26 and become fastened to the latter by the adhesive applied therebetween. Finally, a suitable adhesive may be applied to the interior faces of extension flap 76 which are matingly received within the notches 68 on side wall panel 16 and overlap exterior surfaces area of the latter, thereby firmly anchoring the extension flaps 76 to the side wall panel 16.

Referring now also to FIGS. 3-9, the erected carton generally indicated by the numeral 78 includes a polygonal base 12 having cylindrically shaped side wall sections 14 and 16 formed integral therewith and extending upwardly therefrom. The lower areas of side wall sections 14 and 16 abuttingly conform to the six edges of equal length of the bottom 12 defining the latter's periphery. Y-shaped pleats 46, 48 and 62 are disposed at the juncture of adjacent straight sections of the edges defining the periphery of the bottom wall 12 and function to effect a smooth transition in the outer side walls of the carton from the angular shape thereof imposed by the base 12 to an essentially circular cross-section in intermediate and upper regions thereof. Thus, the opening at the top of the carton 78 is essentially circular in configuration.

The lower regions of the carton 78 are effectively sealed against possible leakage by virtue of the overlapping glue flaps 22, 24, 26 and 28 which are sealed to the interior surface areas of the respectively corresponding side wall sections 14 and 16, and by virtue of the continuity of material on opposite sides of the fold lines 18 and 20.

The adhesively joined and sealed overlapping edges of the side wall sections 14 and 16 eliminate a possibility of leaking therebetween and provide a substantial, longitudinally extending joint which securely holds the sections 14 and 16 in the desired positions thereof. The previously discussed flap members 64 and 72 provide a rolled type rim 80 to further reinforce the upper edge of the side wall sections 14 and 16 and provide surface areas radially spaced outward from the corresponding side wall sections 14 and 16 whereby to permit a user to easily wedge a finger between such lip 82 and the side walls 14 and 16 in order to force the lid 84 off the carton 78. Finally, the extension flaps 76 which are matingly received by the notches 68 in the rim 80 overlap the side walls 16 and further contribute to the solidarity of the joint between side wall sections 14 and 16. Moreover, because the extension flaps 76 and portions of the flap member 64 defining notches 68 abut rather than overlap each other, the possibility that the edge of a lid 84 being installed upon the carton 78 snags an edge of either of the flap member 64 or 72 defining the joint therebetween is substantially reduced. In the same connection, the inclined joint line defined by the extension flaps 76 and notches 68 also contribute to the smooth, unimpeded installation of a lid 84 onto the rim 80 of the carton 78.

Figure 10:
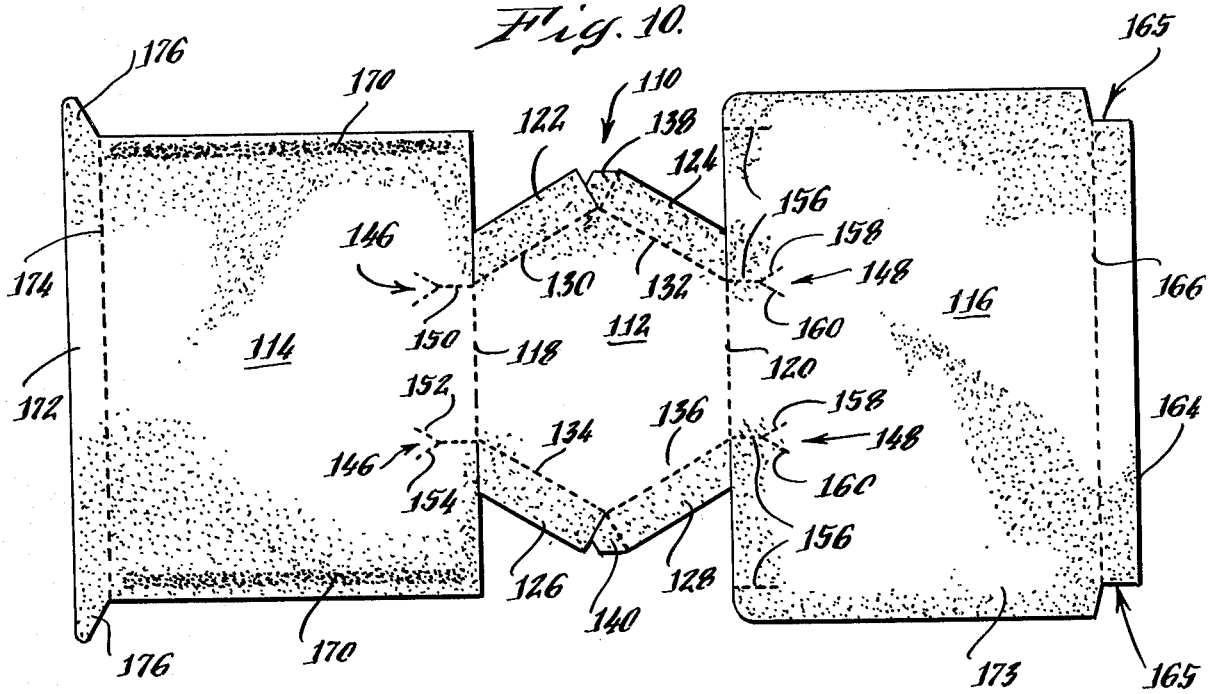
FIG. 10 is a plan view of a blank for forming a round ice cream carton which comprises an alternate form of the present invention.
Figure 11:
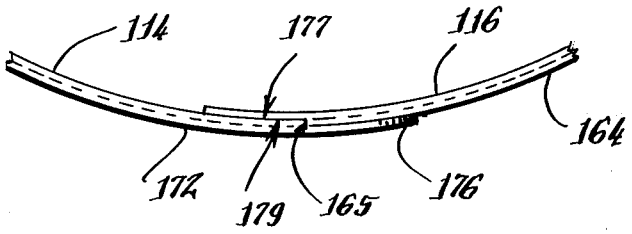
FIG. 11 is a fragmentary, plan view, taken on an enlarged scale, of the rim of a carton formed from the blank of FIG. 10.
Figure 12:
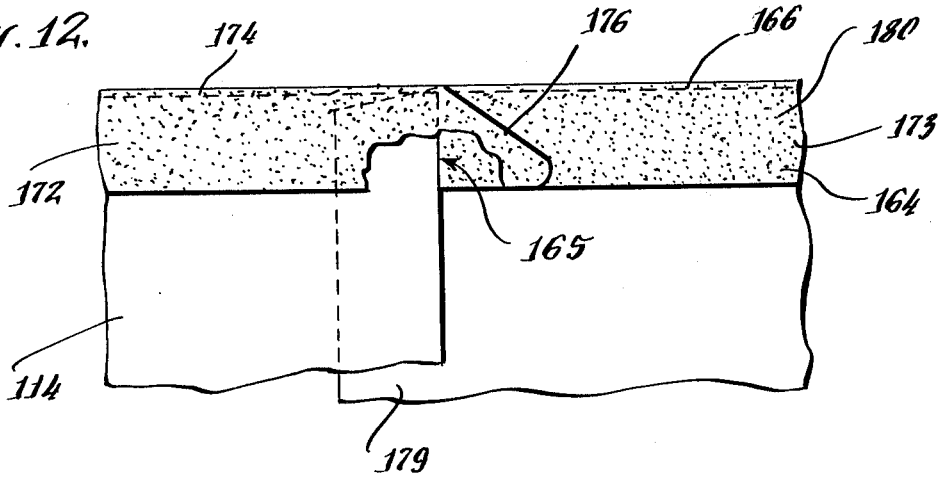
FIG. 12 is an elevational view of the rim detail shown in FIG. 11, parts broken away for clarity.

Attention is now directed to FIGS. 10–12 wherein an alternate form of the invention is shown and parts similar to those previously described are identified with like reference numerals preceded with the numeral "1". As is evident from FIG. 10, the blank 110 is cut and scored quite similar to blank 10 shown in FIG. 1. In contrast, however, blank 110 is provided with a flap member 164 whose opposite extremities include edges 165 which extend perpendicular to the score line 166 and are respectively spaced inwardly toward each other from the top and bottom edges of the side wall panel 116. Blank 110 has a coating 173 applied to one face thereof, similar to the coating 73 applied to the blank 10.

The blank 110 is folded in a manner similar to the process described with reference to blank 10 of FIG. 1. When folded into an erected carton, the interior face of the lateral edges 177 of the side wall panel 114 (which interior face carries the coating 173 thereon) overlaps, and is bonded to, the exterior face of the lateral edges 179 of the sidewall panel 116 (which exterior face is free from the coating 173).

The triangularly shaped extension flap 176 is bonded in overlapping relationship to the exterior face of the flap member 164. The edges 165 of flap member 164 abuttingly engage the lateral edges of the side wall panel 114 while such lateral edges of the side wall panel 114 are complementary received in corresponding notches in side wall panel 116 defined between edges 165 and the lateral edges of side wall panel 116. It is important to note that paper-to-coating contact occurs between the extension flap 176 and the flap member 164 by virtue of the fact that the interior face of the extension flap 176 is free of the coating 173 while the exterior face of the flap member 164 underlying the extension flaps 176 carries the coating 173 thereon. Thus, it can be appreciated that two separate zones of paper-to-coating contact occur at each juncture of side wall panels 114 and 116. It is to be further noted that the exterior face of the entire rim 80, which consists of two reinforcement strips defined by flap members 164 and 172, carries the coating 173 which aids in achieving tight frictional engagement with the lip 82 of the lid 84.

Figure 13:
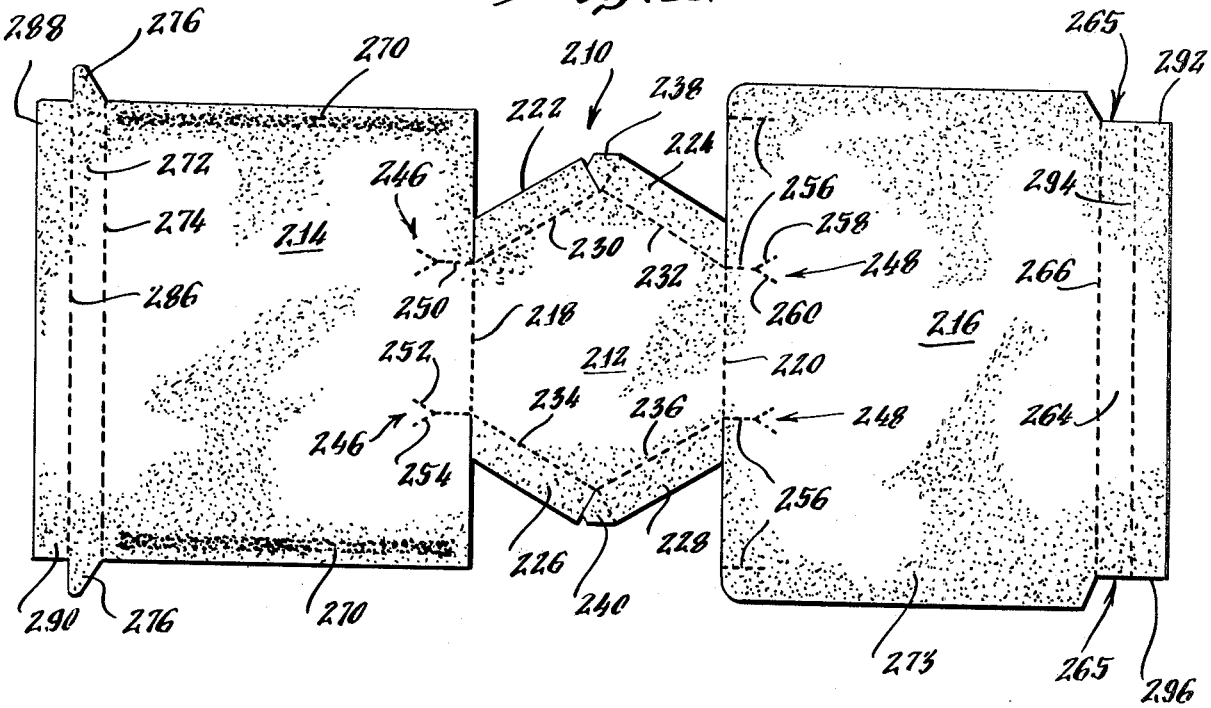
FIG. 13 is a plan view of a blank for forming a round ice cream carton which comprises still another alternate form of the present invention.
Figure 14:
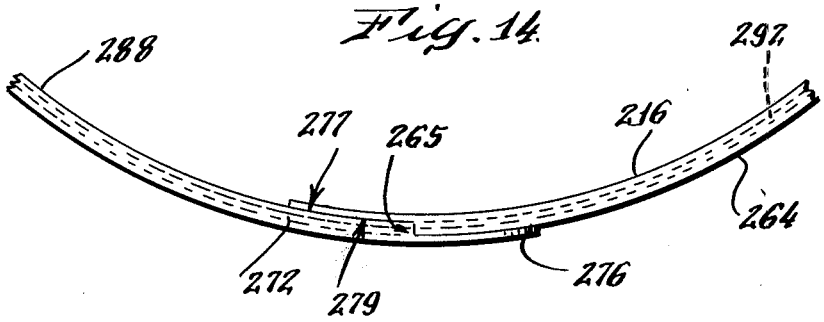
FIG. 14 is a fragmentary, plan view, taken on an enlarged scale, of the rim of a carton formed from the blank shown in FIG. 13.
Figure 15:
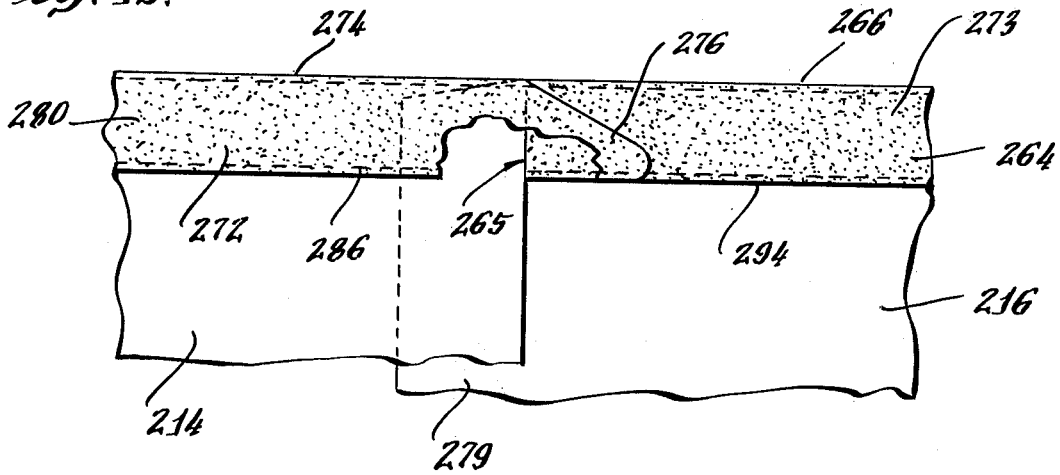
FIG. 15 is an elevational view of the rim detail shown in FIG. 14, parts broken away for clarity.

Reference is now made to FIGS. 13–15 wherein still another form of the invention is shown and parts similar to those previously described with reference to FIGS. 1–9 are identified with like numerals preceded with the numeral "2". The blank 210 shown in FIG. 13 is cut and scored very similar to the blank 110 of FIG. 10 with the following exceptions. Flap member 272 has hingedly connected to the outer edge thereof along fold line 286, a rectangularly shaped strip 288 which may be provided with an elongate strip 290 of adhesive preapplied to the face thereof which carries the coating 273. The width of strip 288 is essentially equal to, or marginally less than, that of flap member 272 while the length thereof is essentially equal to distance between the corresponding lateral edges of side wall panel 214.

Flap member 264 also has a rectangularly shaped strip 292 connected to one edge thereof along fold line 294. Strip 292 has a width equal to, or marginally less than, that of flap member 264, and has a length essentially equal to that of flap member 264. A strip of suitable adhesive 296 may be preapplied to the face of strip 292 which carries the coating 273.

In folding the blank 210 to form the erected carton, strips 288 and 292 are first respectively folded about fold lines 286 and 294 into overlapping relationship to the corresponding flap members 272 and 264. The remaining steps necessary to complete the folding process are identical to those previously described with reference to the folding of blanks 10 and 110.

When fully erected the carton formed from blank 210 is provided with a two piece rim 280 having joints connecting each piece which are similar to the joints previously discussed with reference to FIGS. 11 and 12 and provide two zones of paper-to-coating contact between adjacent overlapping portions of the side wall panels 214 and 216 and respectively connected components. Strip 288 is sandwiched between the flap member 272 and the exterior face of side wall panel 214, while strip 292 is similarly sandwiched between flap member 264 and the exterior face of side wall panel 216. Thus, the rim 280 is of triple thickness which serves to further strengthen the upper part of the carton and provides additional spacing between the lip 82 and the lid 84 and the side walls of carton within which a finger or the like may be wedged when removing the lid 84 from the carton.

It is also noted that the coating 73, 173 and 273 may comprise a material which is subject to melting when exposed to elevated temperatures whereby certain interengaging parts of the carton may be bonded together by selectively melting the coating in the desired locations using a stream of hot air for example.

Figure 16:
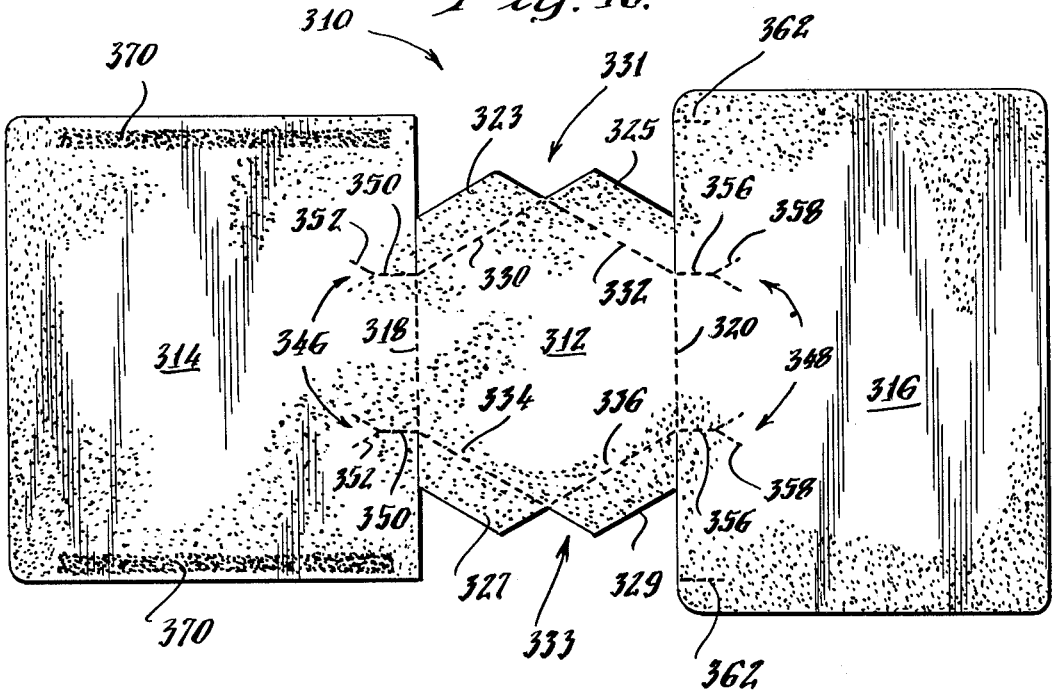
FIG. 16 is a plan view of a blank for forming a round ice cream carton which comprises still another alternate form of the present invention.
Figure 17:
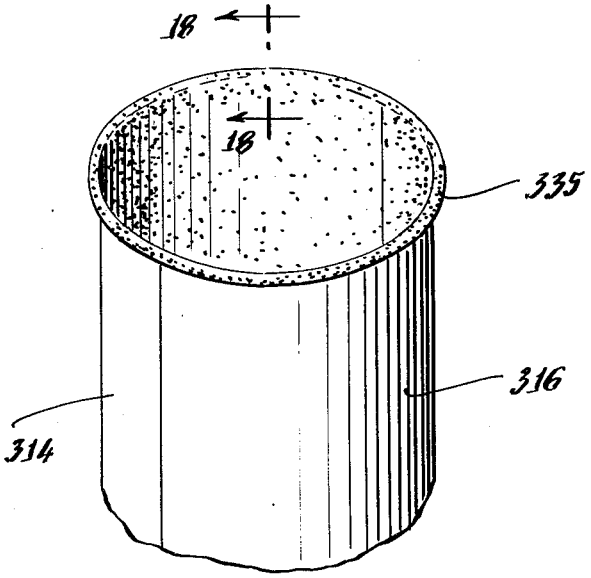
FIG. 17 is a fragmentary, perspective view of the upper portion of the carton erected from the blank shown in FIG. 16.
Figure 18:
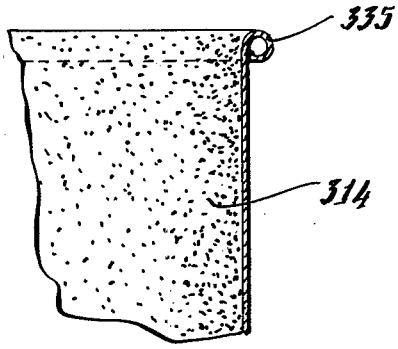
FIG. 18 is a cross-sectional view taken along the line 18—18 in FIG. 17.

It is to be further noted that although the strips and/or flaps, e.g. 64, 72, 164, 172, 264, 272, 288 and 292 are shown as being hingedly connected to each other and to the respectively associated sidewall panels, such strips and/or panels may comprise separate members which are bonded to the carton after the corresponding blank has been erected. Attention is now directed to FIGS. 16–18 wherein another form of the invention is shown and parts similar to those previously described with reference to FIGS. 1–9 are identified with like reference numerals preceded with the numeral "3". The blank 310 is cut and scored generally similar to the blanks 10, 110 and 210, previously discussed, with the following exceptions. The outer edges of side wall panels 314 and 316 are essentially squared off and are devoid of any flap members such as flap members 64 and 72 shown in FIG. 1. Also, the adjacent edges of glue flaps 323, 325, 327 and 329 extend obliquely away from the corresponding fold lines 330, 332, 334 and 336 and define a pair of V-shaped notches 331 and 333 between such edges. The blank 310 is folded into an erected carton 378 in a manner essentially like that followed for folding the blank 10.

After the blank 310 is folded into the erected state thereof, the circular edge defining the opening in the top of the carton is formed radially outward into a rolled, bead type rim 335. The bead-type rim 335 provides a reinforced rim edge which is adapted to frictionally engage any of various types of closure lids (not shown) well known in the art.

From the foregoing, it will be observed that the various embodiments of round carton disclosed herein and blank therefor, provide for the reliable accomplishment of the object of the invention, and do so in a particularly simple, effective, and yet economical manner. It is recognized, of course, that those skilled in the art may make various modifications or additions to the preferred embodiment chosen to illustrate the invention without departing from the gist and essence of the present contribution to the art. Accordingly, it is to be understood that the protection sought and to be afforded hereby should be deemed to extend to the subject matter claimed and all equivalents thereof fairly within the scope of the invention.

What is claimed is:

1. A blank comprising:

first and second generally rectangular spaced apart panels;

a polygonally shaped panel disposed between said first and second panels and hingedly connected to the first edge of each of said latter mentioned panels by a fold line;

first and second strips respectively hingedly connected by corresponding fold lines along a second edge of said first and second panels opposite said first edges and distal from said polygonally shaped panel, said first strip including an extension flap on each of the opposite extremities thereof, each of said extension flaps extending outwardly away from said first panel and beyond corresponding third and fourth edges of said first panel, said second strip including an edge on each of the opposite extremities thereof spaced inwardly away from the corresponding third and fourth edges of said second panel.

2. The blank of claim 1, wherein:

each of said edges on said opposite extremities of said second strip extend essentially perpendicular to said first edge of said second panel, and each of said extension flaps are generally triangular in shape.

3. The blank of claim 1, wherein said blank is formed from a single sheet of paperstock, said paperstock having a coating of moisture resistant, synthetic material on one face thereof.

4. The blank of claim 1, including:

a third strip hingedly connected by a fold line along one edge of said first strip distal from said polygonally shaped panel; and a fourth strip hingedly connected by a fold line along one edge of said second strip distal from said polygonally shaped panel.

5. The blank of claim 4, wherein each of said third and fourth strips are generally rectangular in shape.

6. A blank as recited in claim 1 wherein said polygonal shaped panel is hexagonal in configuration.

7. A blank as recited in claim 6 further including first and second pairs of flap members respectively hingedly connected to the free edges of said hexagonal panel, said flap members being essentially trapizoidal in configuration.

8. A blank as recited in claim 1 wherein each said rectangular side panel further includes a plurality of Y-shaped pleats disposed at the edge of said panel adjacent said polygonally shaped panel.

9. A carton comprising:

a base;

a pair of side wall sections each joined to said base and extending upwardly from said base, said side wall sections being joined to each other along lateral edges thereof to form a container, with the upper edges of said side wall sections defining a generally circular shaped opening in one end of said container opposite said base; and a pair of reinforcement strips respectively joined to said pair of side wall sections adjacent said upper edges of the latter and each disposed in overlapping relationship to exterior surface areas of the corresponding one of said side wall sections, with one of said strips in said pair thereof including a pair of extension flaps on respective opposite extremities thereof, each of said extension flaps extending beyond a corresponding lateral edge of the respective associated side wall section and secured in overlapping relationship to the adjacent extremity of the other one of said strips in said pair thereby defining a rim, and with each said reinforcement strip in said pair including a first and second elongate portion hingedly joined along one mutual elongate edge thereof, said first and second elongate portions being disposed in overlapping relationship to each other, with one of said first and second elongate portions being hingedly connected to the upper edges of the respectively associated side wall section.

10. A carton as recited in claim 9 wherein each of said first and second elongate portions of the other of said strips includes an edge on the opposite extremities thereof spaced from the corresponding lateral edge of said side wall section to which said other strip is hingedly connected, thereby defining a pair of notches in said rim, with each of said edges on said other of said strips extending generally perpendicular to the upper edges of said pair of side wall sections, and with a portion of each of the lateral edges of the side wall section, to which said one strip in said pair thereof is joined, respectively extending into said notches.

11. A carton as recited in claim 10 formed from a single sheet of paper stock.

12. A carton as recited in claim 9 wherein said base is hexagonal in configuration.

13. A carton as recited in claim 12 further including first and second pairs of flap members respectively hingedly connected to the free edges of said hexagonal base, each said flap member extending upwardly from said base and being joined in overlapping relationship to the interior surface areas of the adjacent side wall section, said flap members being essentially trapizoidal in configuration.

14. A carton as recited in claim 12 wherein each said side wall section further includes a plurality of Y-shaped pleats disposed at the edge of said side wall section adjacent said hexagonal base, to facilitate the transition in shape of said side wall sections from a hexagonal shape adjacent said base to an essentially circular shape at the end thereof distal from said base.

15. A carton is recited in claim 9 wherein said extension flaps are triangular in configuration.

* * * * *